US007055435B2

(12) United States Patent
Lloyd

(10) Patent No.: US 7,055,435 B2
(45) Date of Patent: Jun. 6, 2006

(54) SPACECRAFT ORDNANCE SYSTEM AND METHOD FOR SELF-TEST

(75) Inventor: David W. Lloyd, Manhattan Beach, CA (US)

(73) Assignee: The Boeing Company, Chicago, IL (US)

( * ) Notice: Subject to any disclaimer, the term of this patent is extended or adjusted under 35 U.S.C. 154(b) by 339 days.

(21) Appl. No.: 10/442,373

(22) Filed: May 20, 2003

(65) Prior Publication Data

US 2004/0231545 A1 Nov. 25, 2004

(51) Int. Cl.
*F42C 21/00* (2006.01)

(52) U.S. Cl. ..... 102/206; 102/217; 102/218

(58) Field of Classification Search ..... 102/202.5, 102/206, 207, 217, 218
See application file for complete search history.

(56) References Cited

U.S. PATENT DOCUMENTS 4,068,556 A * 1/1978 Foley ..... 89/1.814
6,300,764 B1 * 10/2001 Kelley ..... 324/502
6,386,108 B1 * 5/2002 Brooks et al. ..... 102/217

FOREIGN PATENT DOCUMENTS

FR 2 571 843 * 4/1986

* cited by examiner

*Primary Examiner*—Stephen M. Johnson
(74) *Attorney, Agent, or Firm*—Shimokaji and Associates, P.C.

(57) ABSTRACT

An improved spacecraft ordnance system includes a plurality of squibs each connected with a resistor having a squib unique resistance value and a driver unit including built-in test circuitry. Ordnance harness cables connect the squibs with the driver unit. The resistors enable squib identification. The built-in test circuitry enables unambiguous verification of correct connection of each squib with the driver unit. The built-in test circuitry includes a low-impedance multiplexer for selecting a driver line for monitoring, a precision current source for providing a relatively low current to a selected output of the driver unit producing a voltage proportional to the total resistance from signal to ground, and a analog/digital converter for digitizing the voltage and reporting the result to a computer for comparison to predicted values using a telemetry interface and therefore identifying the selected squib. An EMI-tight adapter housing the squib-specific resistor may be attached to the squib.

20 Claims, 4 Drawing Sheets

SPACECRAFT ORDNANCE SYSTEM AND METHOD FOR SELF-TEST

BACKGROUND OF THE INVENTION

The present invention generally relates to spacecraft ordnance systems and test methods for spacecraft ordnance systems and, more particularly, to an improved spacecraft ordnance system that enables automatic testing of a spacecraft ordnance harness and a method for self-testing of a spacecraft ordnance system.

Spacecraft ordnance systems are explosive release systems that can be used for a variety of pyrotechnic applications such as release systems for antenna tie downs, spacecraft separation devices, mechanism launch locks, and propulsion valves. Spacecraft ordnance systems currently used by Government and industry rely on relatively high electric current to activate these initiators, which require many safeguards to avoid accidentally setting off the initiations.

A typical prior art spacecraft ordnance system 10 is shown in a simplified block diagram in FIG. 1. The spacecraft ordnance system 10 comprises an electrical bridgewire initiation system. For example, a standard initiator 11 (hereafter called "squib") is connected to a driver unit 13 via a dedicated harness cable 14 comprising a shielded twisted pair of cables. The harness cable 14 is wired to a harness connector 15 providing easy connection between the output of driver unit 13 and the squib 11. Only two squibs, squib 11 and squib 12, are shown in FIG. 1 for simplicity; however, there may be over 100 individual squibs installed on a large spacecraft. The driver unit 13 provides the switching and the current drive necessary to individually fire the squibs. The driver unit 13 comprises multiple switches such that no fewer than three failures can result in an inadvertent squib firing. This is required because squibs are explosive devices and represent a personnel safety hazard. In normal operation, an enable switch 130 is first to be closed, followed by the appropriate arm switch, for example, arm switch 131 arms squib 11, arm switch 132 arms squib 12, etc. The fire switch 133 is then closed, allowing a current of 5 to 6 amperes to flow through the selected squib, causing a small explosive reaction. This in turn allows the mechanism to which the squib is attached (bolt cutter, pin puller, tie down, etc.) to actuate.

Since proper squib firing is absolutely critical to mission success, verification of proper installation of the squib harness cables 14 and 141 in the spacecraft test is also critical. Currently, testing of the spacecraft ordnance system is done manually using a specially designed low current, low range ohmmeter. Test points, for example test points 17, 18 and 19, which allow access to the actual harness wires, are located inside the driver unit 13. To test the continuity of squib 11, for example, the ohmmeter probes are placed on test point 17 and 19. A resistance reading is taken and then manually compared with given pass/fail limits. This resistance measurement process needs to be repeated for each squib circuit. Furthermore, the entire test needs to be repeated several times during the space vehicle integration and test process.

This manual verification process for testing a spacecraft ordnance harness has several disadvantages. It is not possible to unambiguously verify that the proper output of driver unit 13 is wired to the proper squib in the proper location by applying the described test procedure. This can result in squib circuits being swapped or miswired by human error, which can lead to severe on-orbit problems at the point when deployments or propulsion system initializations are performed. Further, the testing of a spacecraft ordnance harness as described above is manual measurement-intensive, and therefore requires a considerable amount of time causing increased cycle time and test cost. Since tests are performed manually, they cannot be performed after the spacecraft is closed out prior to shipment to launch site. The described test for a spacecraft ordnance system also requires specialized test equipment, such as a low-range ohmmeter. Further, the test procedure directly exposes live squibs to potential electrostatic discharge sources, which represents a potential personnel safety hazard. This potential personnel safety hazard is traditionally mitigated by operators wearing ESD grounding protection, but this approach is not foolproof. Also the manual verification process requires the driver unit 13 to be placed outside of the spacecraft for test access purpose exposing the driver unit 13 to a severe environment. If placed inside a spacecraft, the driver unit 13 requires a heavy shielded test access harness, which must fly with the spacecraft, even though the driver unit 13 is only used during testing.

Prior art describes several methods to guarantee that the proper output of a driver unit is connected to the proper squib. For example, color-coding of the squib and the mating harness connector was employed, but this method relies on human judgment and has proven to be ineffective. This method also requires a visual inspection of each mating harness connector; which is not possible after a certain stage in spacecraft-level integration. Pin programming of each squib (i.e. giving each squib its own jumper wire programmed address) was disclosed, but this approach is impractical because it requires the driver unit to interrogate many programming wires from each squib, greatly increasing the wire harness complexity, weight, and cost. Further, mechanical keying of each squib connector was proposed. This is also impractical because it requires a modification to the existing NASA Standard Initiator and therefore increases the cost, requires stocking up to 100 different types of squibs, each with a different key, along with 100 different types of mating connectors, and requires the wire harness designer to have a priori knowledge of the specific key used for each squib at each location. This adds to schedule cycle time and cost. Finally, proposals were made for "intelligent" squibs containing active electronics, in which the squib reports its identity back to the driver unit via a simple digital interface. In addition to being relatively costly, this approach is impractical because of the extremely harsh temperature and radiation environment at many squib locations on the spacecraft. Traditional active electronics are not capable of withstanding these environmental conditions.

There has, therefore, arisen a need for the development of a method for testing of a spacecraft ordnance harness that makes it possible to unambiguously verify that the proper output of the driver unit is wired to the proper squib in the proper location. There has further arisen a need to specify the squibs to allow determination of correct harness routing eliminating the chance of human error. There has also arisen a need to modify the driver unit of the spacecraft ordnance system to enable automatic testing of a spacecraft ordnance harness, to reduce cycle time and test cost, to eliminate the need for specialized test equipment, and to eliminate the potential personnel safety hazard, as connected with manual testing. There has still further arisen a need for the development of an improved spacecraft ordnance system that enables automatic testing of the spacecraft ordnance harness allowing the driver unit to be placed inside the spacecraft where it may be protected from the relatively harsh temperature and radiation environment outside of the spacecraft and allowing the spacecraft ordnance system to be tested at any time during the spacecraft integration and test process, up to and including launch.

As can be seen, there is a need for an improved spacecraft ordnance system that enables automatic testing of a spacecraft ordnance harness and eliminates manual work and human error. Also, there is a need for specification of each squib that allows the determination of correct harness routing. Moreover, there is a need for a method for self-testing of a spacecraft ordnance system providing cost-effective and unambiguous verification that the proper output of the driver unit is wired to the proper squib in the proper location at any time during spacecraft integration, up to and including launch.

SUMMARY OF THE INVENTION

The present invention provides an improved spacecraft ordnance system including a driver unit with added built-in test circuitry suitable for, but not limited to, automatic testing of a spacecraft ordnance harness. The present invention also provides a squib having a resistor of a squib unique resistance value attached for determination of correct harness routing. The present invention further provides a method for self-testing of a spacecraft ordnance system enabling unambiguous verification of correct connection of an output of the driver unit and a squib.

In one aspect of the present invention, a spacecraft ordnance system comprises a standard squib, a resistor, a driver line having an output, a driver unit, and test circuitry built into the driver unit that enables verification of correct connection of the standard squib with the output of the driver unit. The resistor has a unique resistance value, and has a first end and a second end, wherein the second end of the resistors is connected to ground and the first end of the resistor is connected with the standard squib. The driver line has a first end and a second end, the first end of the driver line is connected with the standard squib and the second end is connected with an output of the driver unit. The combination of the driver line, the resistor, and the standard squib forms an extended squib having a unique resistance value.

In another aspect of the present invention, a built-in test system for automatic testing of a spacecraft ordnance system comprises a standard squib, a driver unit having an output and a telemetry interface, a driver line, test circuitry built into the driver unit, and a resistor having a unique resistance value and being connected with the standard squib. The driver line connects the output of the driver unit with the standard squib.

In still another aspect of the present invention, an EMI (electromagnetic interference)-tight adapter comprises an adapter case having a first end and a second end, a resistor having a unique resistance value and being placed inside of the adapter, a pair of connector sockets located at the first end of the adapter case for mating with a standard squib, and a pair of connector pins at the second end of the adapter case for mating with an ordnance harness connector.

In a further aspect of the present invention, a spacecraft ordnance system comprises a standard squib, a resistor having a unique resistance value, and wherein the resistor is connected with the standard squib, an EMI-tight adapter, wherein the resistor is placed inside of the EMI-tight adapter, a driver line, wherein the driver line is connected with the standard squib, a driver unit having an output and a telemetry interface, wherein the output of the driver unit is connected with the driver line, and test circuitry built into the driver unit that enables verification of correct connection of the standard squib with the output of the driver unit. The test circuitry built into the driver unit includes a low-impedance multiplexer that selects the driver line for monitoring, a precision current source that provides a current to the selected driver line and produces a voltage proportional to the total resistance between the selected driver line and ground, and an analog/digital converter that digitizes the voltage and reports the voltage to a computer for comparison to predicted values using the telemetry interface of the driver unit identifying the standard squib.

In yet another aspect of the present invention, a method for self-testing of a spacecraft ordnance system includes the steps of: providing a spacecraft ordnance system to be tested, providing a built-in test system including test circuitry and a resistor having a unique resistance value, incorporating the test circuitry including a low-impedance multiplexer, a precision current source, and an analog/digital converter into the driver unit of the spacecraft ordnance system, attaching the resistor to the standard squib, selecting the standard squib for monitoring with the low-impedance multiplexer, providing a current to the output of the driver unit using the precision current source and producing a voltage proportional to the total resistance between the ordnance harness cable and ground, digitizing the voltage with the analog/digital converter, reporting the voltage to a computer, and comparing the voltage to predicted values identifying the selected standard squib.

These and other features, aspects and advantages of the present invention will become better understood with reference to the following drawings, description and claims.

DETAILED DESCRIPTION OF THE INVENTION

Figure 1:
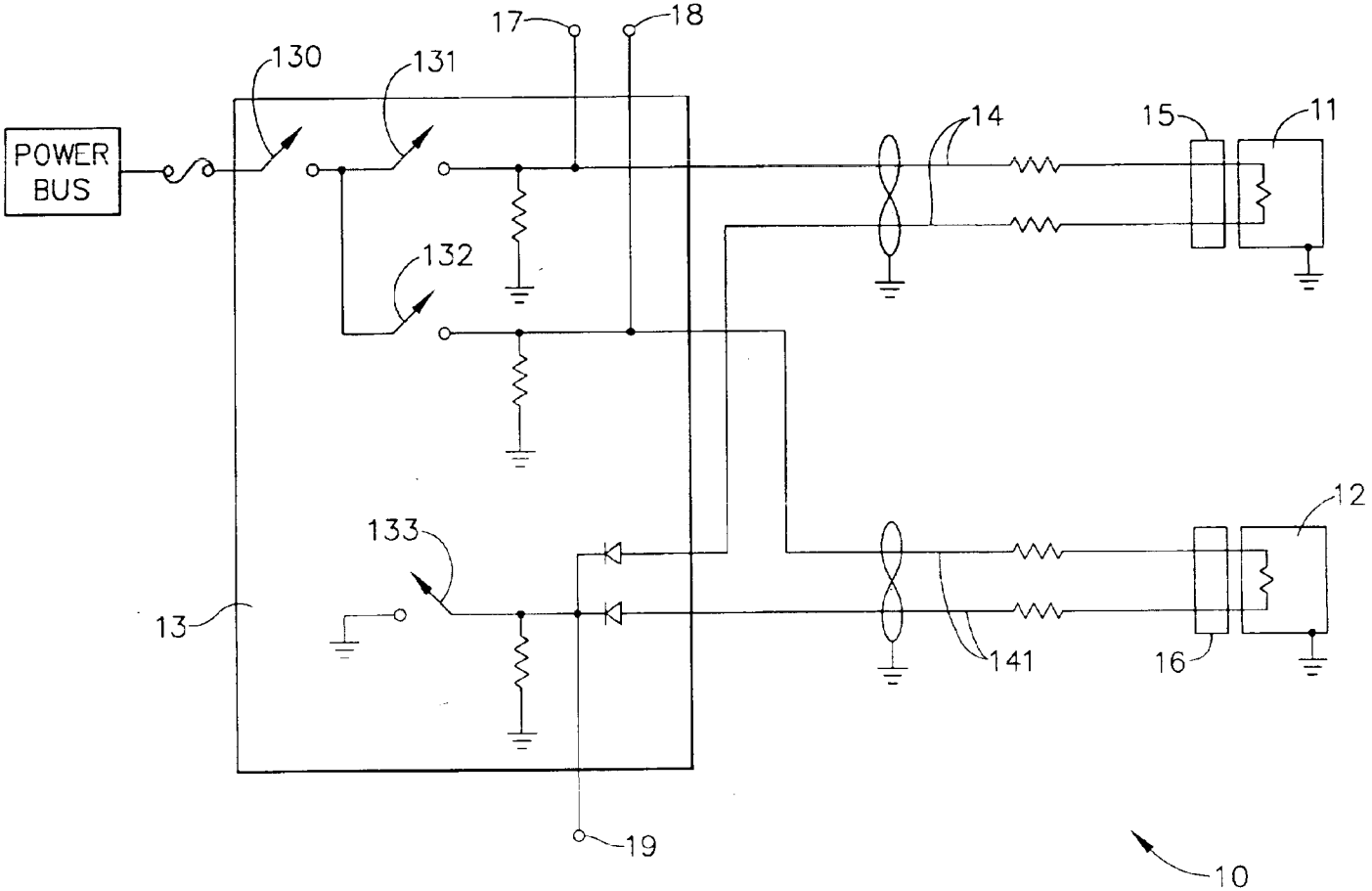
FIG. 1 (PRIOR ART)
FIG. 1 is a simplified block diagram of a typical prior art spacecraft ordnance system.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides an improved spacecraft ordnance system including a driver unit with added built-in test circuitry suitable for automatic testing of a spacecraft ordnance harness. The present invention also provides a squib having a resistor of a squib unique resistance value attached for determination of correct harness routing. The present invention further provides a method for self-testing of a spacecraft ordnance system enabling unambiguous verification of a correct connection of an output of the driver unit and a squib.

The spacecraft ordnance system of the present invention may be used for automatic testing of an ordnance harness of a spacecraft, missile or other vehicle, that use NASA Standard Initiators or other commercially available initiators as squibs. Since NASA Standard Initiators or other commercially available initiators are used in the present invention and built-in test circuitry of the present invention is added to an existing prior art driver unit of a spacecraft ordnance system, the need for special measuring equipment has been eliminated and a cost-effective method for unambiguous verification of the proper connection between an output of driver unit and a squib at a certain location has been introduced.

In one embodiment, the present invention provides a spacecraft ordnance system including a modified driver unit with added built-in test circuitry. By providing built-in test circuitry, the value of a squib-specific resistor that is connected with a squib can be sensed and then be reported to a computer for analysis using an existing telemetry interface. Consequently, the squib can be unambiguously verified. The computer may be part of the existing system test equipment and therefore external to the spacecraft or the computer may be part of the existing spacecraft data handling system and therefore on board the spacecraft, not adding to the system cost. By incorporating the built-in test circuitry of the present invention into a standard spacecraft ordnance system the need for manual testing can be eliminated, saving cost and cycle time during spacecraft integration and test. Further, the use of the built-in test circuitry does not impact the existing tools and procedures used to design, route, manufacture, and install the ordnance wire harness.

In one embodiment, the present invention provides a spacecraft ordnance system including squibs that are connected with a resistor, wherein a first end of the resistor is connected with a standard squib and a second end of the resistor is connected to ground. Each squib has a resistor with a squib unique resistance value assigned. Since modifying an existing squib, such as a NASA Standard Initiator or other commercially available initiator would be impractical and expensive, a small, cylindrical, EMI (electromagnetic interference)-tight adapter including the squib-specific resistor has been developed. The EMI-tight adapter of the present invention includes a resistor with a squib unique resistance value and connects the existing squib with the ordnance harness. In order to be able to unambiguously verify that the proper output of the driver unit is connected to the proper squib at the proper location, the adapter including the squib-specific resistor should be permanently attached to the existing squib before installation of the squib. A bonding material for attaching the adapter to an existing squib should be of such nature that it is difficult but not impossible to remove the adapter from the squib. By using the EMI-tight adapter of the present invention, the range safety or EMI integrity of the ordnance system is not compromised, and the existing squibs, such as NASA Standard Initiators or other commercially available initiators, do not have to be modified which is cost and time saving.

Since the improved spacecraft ordnance system of the present invention allows the ordnance harness of a spacecraft to be automatically tested, there would no longer be a requirement to locate the driver unit of the spacecraft ordnance system on the outside of the spacecraft to provide test access. The driver unit could now be placed inside the spacecraft or other vehicle along with other spacecraft bus electronics. This has several benefits. The driver unit could be placed closer to many of the squibs it is controlling, thereby reducing the length of the ordnance harness and thus the harness weight. The lower radiation environment within the spacecraft would allow the driver unit to use less shielding, reducing the unit weight. Finally, placing the driver unit inside the spacecraft would make it possible to combine the squib driver function with other spacecraft electronics in the same box, reducing total recurring cost and weight and therefore simplifying the spacecraft integration.

Figure 2:
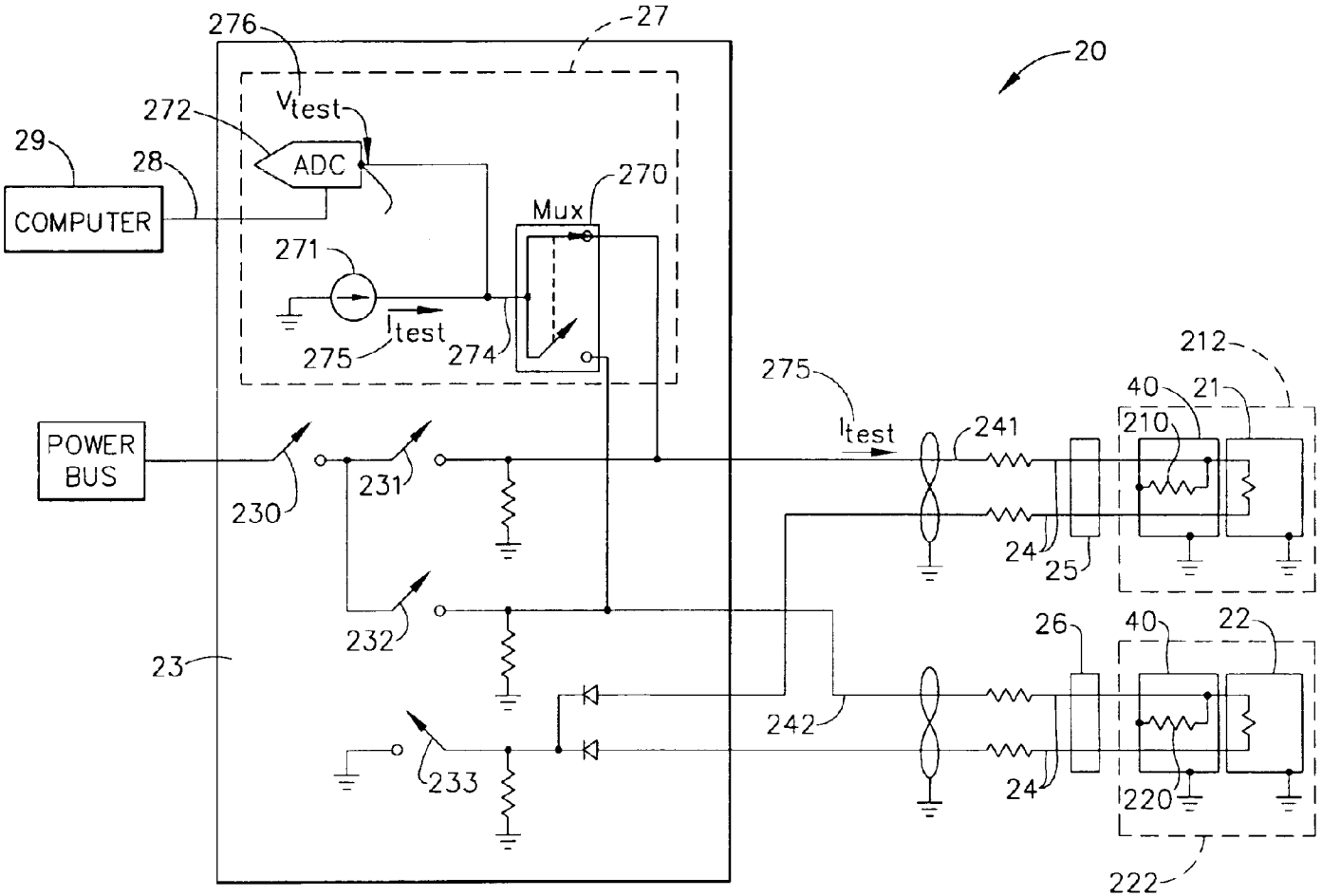
FIG. 2 is a simplified block diagram of a spacecraft ordnance system according to one embodiment of the present invention.

Referring now to FIG. 2, a spacecraft ordnance system 20 is illustrated in a simplified block diagram according to one embodiment of the present invention. The spacecraft ordnance system 20 may include squib 21 and squib 22 each connected via ordnance harness cables 24 to a driver unit 23. Squib 21 and squib 22 comprise NASA Standard Initiators or other commercially available initiators. Only two squibs, squib 21 and squib 22, are shown in FIG. 2 for simplicity; however there may be over 100 individual squibs installed on a large spacecraft, wherein the total number of squibs is n. Each harness cable 24 comprises a dedicated shielded twisted pair of cables including a driver line, for example driver line 241 and 242. One harness cable 24 may include a harness connector 25 for connecting squib 21 with an output of driver unit 23 while another harness cable 24 may include a harness connector 26 for connecting squib 22 with another output of driver unit 23. In general, each squib may be connected with a resistor $R_A$ having a unique resistance value. The resistor $R_A$ (210 or 220) may also be placed in an EMI-tight adapter 40. Therefore, squib 21 may be connected with a resistor $R_A$ 210 and squib 22 may be connected with a resistor $R_A$ 220, as shown in FIG. 2. A first end of the resistor $R_A$ 210 is connected with the standard squib 21 and a second end of the resistor $R_A$ 210 is connected to ground. A first end of the resistor $R_A$ 220 is connected with the standard squib 22 and a second end of the resistor $R_A$ 220 is connected to ground. The combination of the driver line 241, the resistor 210, and the standard squib 21 forms an extended squib 212 having a unique resistance value. The combination of the driver line 242, the resistor 220, and the standard squib 22 forms an extended squib 222 having a unique resistance value. The total number of extended squibs (for example, 212 and 222) installed on a large spacecraft is n. Since each extended squib (for example, extended squib 212) is connected with an output of the driver unit 23, the total number of driver unit 23 outputs is also n.

The driver unit 23 provides the switching and the current drive necessary to individually fire the squibs, for example squib 21 and squib 22. The driver unit 23 is designed having multiple switches (switches 230, 231, 232, and 233) such that no fewer than three failures can result in an inadvertent squib firing. In normal operation, an enable switch 230 is first to be closed, followed by the appropriate arm switch, for example arm switch 231 activates squib 21, arm switch 232 activates squib 22, etc. The fire switch 233 is then closed, allowing a relatively high current (for example 5 to 6 amperes) to flow through the selected squib (squib 21 or squib 22), causing a relatively small explosive reaction. This in turn allows the mechanism to which the squib is attached (bolt cutter, pin puller, tie down, etc.) to actuate.

Since proper squib firing is absolutely critical to mission success, verification of proper installation of the squib harness cables 24 in the spacecraft test is also critical. To enable unambiguous verification that the proper output of driver unit 23 is connected to the proper squib at the proper location and to enable automatic built-in testing of a spacecraft ordnance harness, the driver unit 23 of the spacecraft ordnance system 20 may further include built-in test circuitry 27, as shown in FIG. 2. The built-in test circuitry 27 may include a low-impedance multiplexer 270, a precision current source 271, and an analog/digital converter 272. The output 274 of the multiplexer 270 is connected to the precision current source 271 and to the input 279 of the analog/digital converter 272. The following example for unambiguous identification of squib 21 is used to illustrate the operation of the built-in test circuitry 27. The built-in test circuitry 27 of the current invention can be used to automatically test and verify all squibs installed on a large spacecraft individually.

The low-impedance multiplexer 270 may be used to select one of the driver lines for monitoring. When driver line 241 is selected, driver line 241 is connected to output 274 of multiplexer 270, as shown in FIG. 2. Consequently, the precision current source 271 provides a relatively low current $I_{test}$ 275 via output 274 of the multiplexer 270 to the selected driver line 241. This produces a voltage $V_{test}$ 276 at the input 279 of the analog/digital converter 272. This voltage $V_{test}$ 276 is then digitized by the analog/digital converter 272 and reported via an existing telemetry interface 28 to a computer 29 for comparison to predicted values. The computer 29 may be either external to the spacecraft such as being part of the already existing system test equipment or may be on board of the spacecraft such as being part of the already existing spacecraft data handling system. Therefore, the built-in test circuitry 27 is able to sense the unique resistance value of the squib unique resistor 210 and to report the resistance value via the existing telemetry interface 28 to the computer 29 for analysis. Consequently, the squib 21 can be unambiguously verified.

Figure 3:
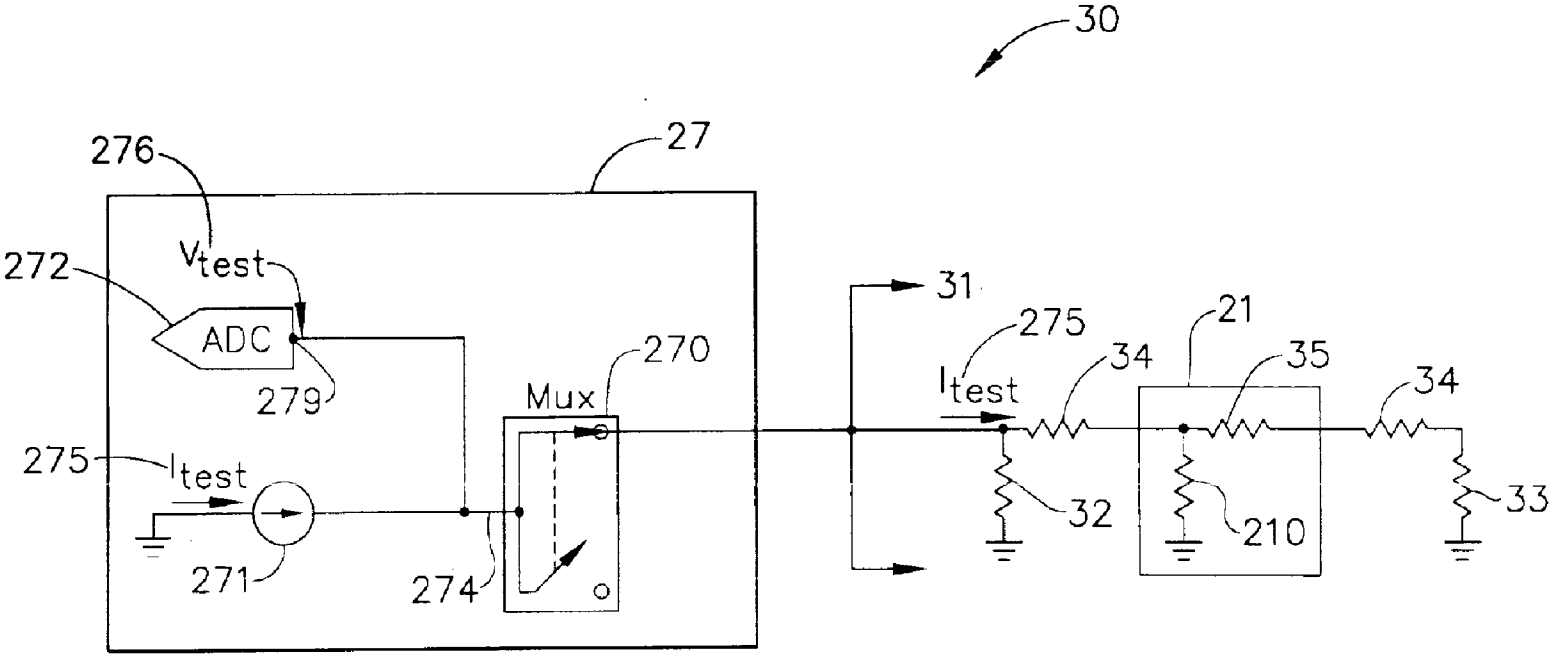
FIG. 3 is a simplified block diagram of a built-in test system according to one embodiment of the present invention.

Referring now to FIG. 3, a built-in test system 30 is illustrated in a simplified block diagram according to one embodiment of the present invention. The built-in test system may include the built-in test circuitry 27 (as described in FIG. 2) connected to several squibs, for example squib 21. Squib 21 may include a resistor $R_A$ 210 having a squib unique resistance value. The squib unique resistance value of the resistor $R_A$ 210 may be chosen from the range of 5.5 kOhms to 12.5 kOhms resulting in a total equivalent resistance $R_{eq}$ 31 in the range from 5 kOhms to 10 kOhms. According to Ohm's Law the resulting test voltage $V_{test}=I_{test}*R_{eq}$. The analog/digital converter 272 may comprise an 8 bit analog/digital converter with a 0 volt to 10 volts range that gives a resolution of 0.040 volts. If the current $I_{test}$ 275 provided by the precision current source 271 is 1 mA then the resulting test Voltage $V_{test}$ 276 will be in a 5 volts to 10 volts range. With the analog/digital converter 272 giving a resolution of 0.040 volts there are subsequently 125 possible values. Therefore, by selecting appropriate values for the squib-specific resistors, for example resistor 210, it is practical to uniquely identify over 100 different squibs, such as squib 21. Further, resistor 32 is identical in value with resistor 33 and may have a value of approximately 100 kOhms, resistor 34 may have a value of approximately 5 ohms, and resistor 35 may have a value of approximately 1 ohm, as shown in FIG. 3. Resistor 32 and resistor 34 are related to wiring resistance. The resistors 33, 34, and 35 are standard squib resistors.

Figure 4:
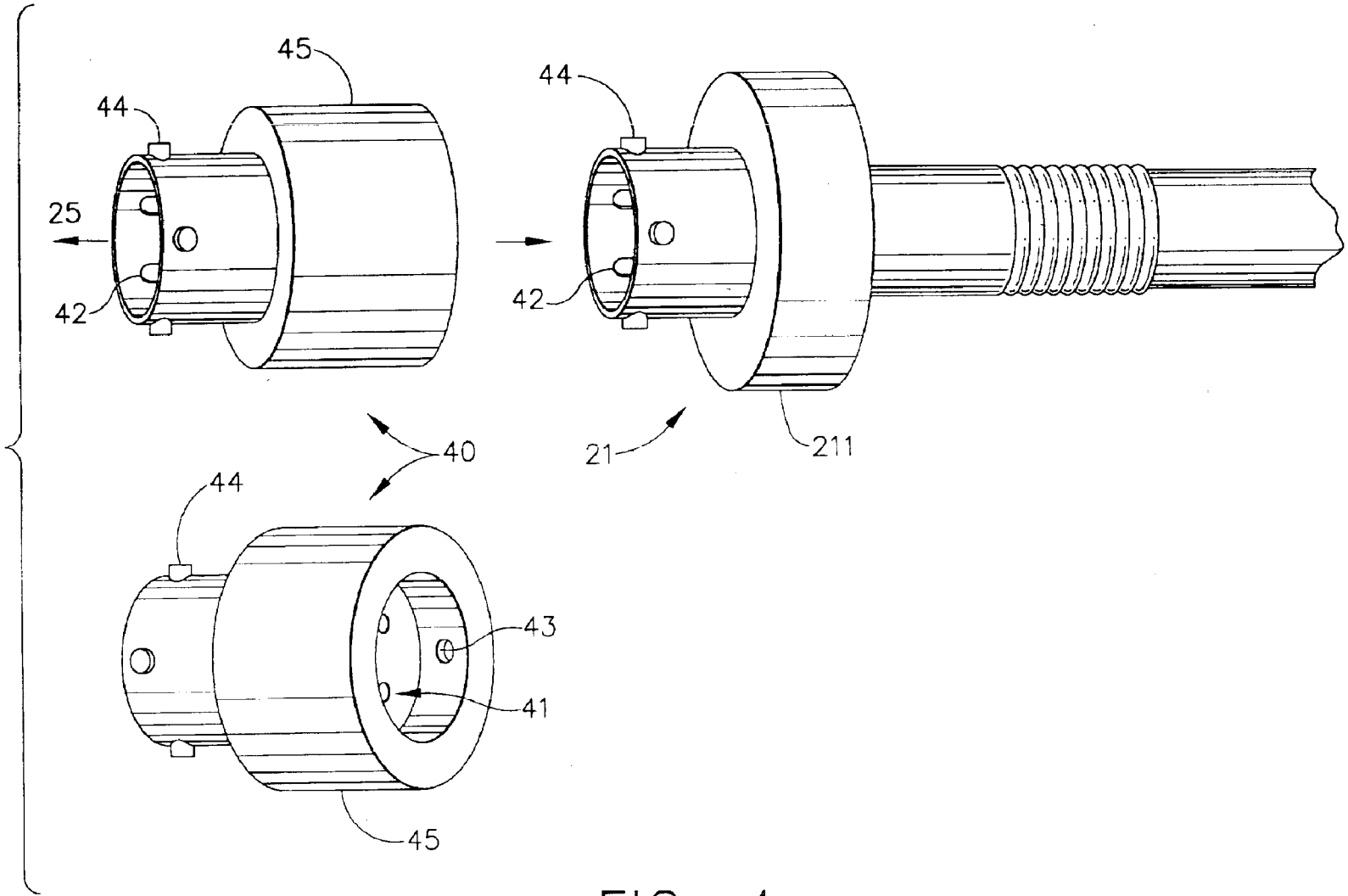
FIG. 4 is a perspective view of an adapter for coupling a squib with a spacecraft ordnance harness according to one embodiment of the present invention.

Referring now to FIG. 4, an adapter 40 for coupling a squib 21 with a spacecraft ordnance harness connector 25 is illustrated according to one embodiment of the present invention. The adapter 40 may comprise a relatively small, cylindrical, EMI (electromagnetic interference)-tight adapter as shown in FIG. 4. The adapter 40 may include an adapter case 45, connector sockets 41 at one-end and connector pins 42 at the other end of the adapter case 45. The connector sockets 41 are provided for mating with the squib 21. The squib 21 may comprise a commercially available NASA Standard Initiator, as shown in FIG. 4. The connector pins 42 are provided for mating with an ordnance harness connector 25. Each adapter 40 may house a resistor $R_A$ having a squib unique resistance value. Therefore, adapter 40 to be connected with squib 21 may include a resistor $R_A$ 210, as shown in FIG. 2. Each adapter might be given a unique dash number based on its specific resistor value. The resistor $R_A$ 210 might be placed in the adapter 40 such that a first end of the resistor $R_A$ 210 is connected with the standard squib 21 and a second end of the resistor $R_A$ 210 is connected to ground (i.e. adapter case 45 or squib case 211). The resistor $R_A$ 210 might be placed in the adapter 40 after the adapter 40 is connected with the harness connector 15. In order to be able to verify that each output of driver unit 23 (as shown in FIG. 2) is connected to the proper squib (for example squib 21), the resistor $R_A$ 210 may be physically and for all practical purposes permanently attached to the squib itself, for example to the squib 21. Further, the resistor $R_A$ 210 should not be part of the spacecraft ordnance harness to avoid that simply swapping harness connectors (for example harness connector 25 and 26, as shown in FIG. 2) would lead to an erroneous measurement. Therefore, squib 21 and adapter 40 should be mated before squib installation. A twist and lock mechanism may be used to connect the adapter 40 to the harness connector 25 or 26 at one end and to the squib 21 on the other end. The twist and lock mechanism may include cutouts 43 on the inside of the adapter case 45 at the end of the connector sockets 41 and joints 43 at the outside of the adapter case 45 at the end of connector pins 42. Further, the squib 21 and the adapter 40 may be permanently bonded using torque striping or another approved bonding material that can be applied to either the outside of the squib case 211 or the inside of the adapter case 45 at the mating ends before mating. The bond between the squib 21 and the adapter 40 should be of such nature that it is difficult but not impossible to remove the adapter 40. By providing the adapter 40 including a resistor having a squib unique resistance value and connecting the adapter 40 to a squib, the squib can be unambiguously identified.

It should be understood, of course, that the foregoing relates to preferred embodiments of the invention and that modifications may be made without departing from the spirit and scope of the invention as set forth in the following claims.

I claim:

1. A spacecraft ordnance system, comprising:

a squib;

a resistor, wherein said resistor has a unique resistance value, and wherein said resistor has a first end and a second end, said second end of said resistor being connected to ground, and said first end of said resistor being connected with said squib;

a driver line, wherein said driver line has a first end and a second end, said first end of said driver line being connected with said squib, and wherein the combination of said driver line, said resistor, and said squib forms an extended squib having a unique resistance value;

a driver unit having an output, wherein said output is connected with said second end of said driver line;

test circuitry built into said driver unit that enables verification of correct connection of said squib with said output of said driver unit; and an ordnance harness cable, wherein said driver line is placed inside said ordnance harness cable.

2. The spacecraft ordnance system of claim 1, further comprising at least one additional extended squib and at least one additional output of said driver unit, wherein said extended squib is connected with said additional output of said driver unit.

3. The spacecraft ordnance system of claim 1, wherein said ordnance harness cable comprises a shielded twisted pair of cables.

4. The spacecraft ordnance system of claim 1, further comprising an EMI-tight adapter, wherein said resistor is placed inside of said EMI-tight adapter.

5. The spacecraft ordnance system of claim 1, wherein said driver unit further comprises:

an enable switch that activates said spacecraft ordnance system;

an arm switch, wherein said arm switch is connected in series with said enable switch, and said arm switch arms said squib; and a fire switch allowing a current to flow through said armed squib, causing an explosive reaction actuating a mechanism attached to said armed squib.

6. The spacecraft ordnance system of claim 1, wherein said test circuitry further comprises:

a low impedance multiplexer, wherein said multiplexer is connected with said output of said driver unit, and that selects said driver line for monitoring;

a precision current source that provides a current to said selected driver line and produces a voltage proportional to the total resistance between said second end of said selected driver line and said ground; and an analog/digital converter that digitizes said voltage and reports said voltage to a computer for comparison to predicted values identifying said squib.

7. A built-in test system for automatic testing of a spacecraft ordnance system, comprising:

a squib, a driver unit having an output and a telemetry interface;

a driver line, wherein said driver line connects said output of said driver unit with said squib;

test circuitry built into said driver unit; and a resistor having a unique resistance value selected form the range of 5.5 kOhms to 12.5 kOhms, wherein said resister is connected with said squib.

8. The built-in test system for automatic testing of a spacecraft ordnance system of claim 7, wherein said test circuitry further comprises:

a low-impedance multiplexer that selects said driver line for monitoring;

a precision current source that provides a current to said selected driver line and produces a voltages proportional to the total resistance between said selected driver line and ground; and an analog/digital converter that digitizes said voltage and reports said voltage to a computer for comparison to predicted values using said telemetry interface of said driver unit identifying said squib.

9. The built-in test system for automatic testing of a spacecraft ordnance system of claim 8, wherein said analog/digital converter comprises an 8 bit analog/digital converter having a 0 volt to 10 volts range and giving a resolution of 0.040 volts.

10. The built-in test system for automatic testing of a spacecraft ordnance system of claim 8, wherein said precision current source provides a test current of 1 mA.

11. A spacecraft ordnance system, comprising:

a squib;

a resistor having a unique resistance value, wherein said resistor is connected with said squib;

an EMI-tight adapter, wherein said resistor is placed inside of said EMI-tight adapter i;

a driver line, wherein said driver line is connected with said squib;

a driver unit having an output and a telemetry interface, wherein said output of said driver unit is connected with said driver line; and test circuitry built into said driver unit that enables verification of correct connection of said squib with said output of said driver unit, including:

a low-impedance multiplexer that selects said driver line for monitoring;

a precision current source that provides a current to said selected driver line and produces a voltage proportional to the total resistance between said selected driver line and ground; and an analog/digital converter that digitizes said voltage and reports said voltage to a computer for comparison to predicted values using said telemetry interface of said driver unit identifying said squib.

12. The spacecraft ordnance system of claim 11, wherein said resistor has a unique resistance value selected from the range of 5.5 kOhms to 12.5 kOhms, said analog/digital converter comprises an 8 bit analog/digital converter having a 0 volt to 10 volts range and giving a resolution of 0.040 volts, and said precision current source provides a test current of 1 mA.

13. The spacecraft ordnance system of claim 11, wherein said computer is included in system test equipment and is located external to a spacecraft.

14. The spacecraft ordnance system of claim 11, wherein said computer is included in a spacecraft data handling system and is located on board a spacecraft.

15. A method for self-testing of a spacecraft ordnance system, comprising the steps of:

providing a spacecraft ordnance system to be tested including a squib, a driver unit having an output, and an ordnance harness cable, wherein said ordnance harness cable connects said squib with said output of said driver unit;

providing a built-in test system including test circuitry and a resistor having a unique resistance value, and wherein the combination of said squib, said resistor, and said ordnance harness cable forms an extended squib;

incorporating said test circuitry including a low-impedance multiplexer, a precision current source, and an analog/digital converter into said driver unit of said spacecraft ordnance system;

attaching said resistor to said squib;

selecting said squib for monitoring with said low-impedance multiplexer;

providing a current to said output of said driver unit using said precision current source and producing a voltage proportional to the total resistance between said ordnance harness cable and ground;

digitizing said voltage with said analog/digital converter;

reporting said voltage to a computer; and comparing said voltage to predicted values identifying said squib.

16. The method for self-testing of a spacecraft ordnance system of claim 15, further comprising the steps of providing at least one additional extended squib and one additional output of said driver unit, such that the total number of said extended squibs is n and the total number of said outputs of said driver unit is n, and wherein each of said extended squibs has a unique resistance value.

17. The method for self-testing of a spacecraft ordnance system of claim 15, further comprising the steps of:

providing an EMI-tight adapter, wherein said adapter includes an adapter case, and said adapter includes connector sockets for mating with said squib and connector pins for mating with said ordnance harness cable;

placing said resistor in said adapter;

connecting said adapter with said squib before installation of said squib; and connecting said ordnance harness cable to said adapter during installation of said spacecraft ordnance system.

18. The method for self-testing of a spacecraft ordnance system of claim 15, further comprising the steps of connecting said adapter with said squib and connecting said adapter with said ordnance harness cable utilizing a twist and lock mechanism.

19. The method of claim 15, wherein said resistor has a unique resistance value selected from the range of 5.5 kOhms to 12.5 kOhms, said analog/digital converter comprises an 8 bit analog/digital converter having a 0 volt to 10 volts range and giving a resolution of 0.040 volts, and said precision current source provides a test current of 1 mA.

20. A spacecraft ordnance system, comprising:

a first squib;

a first resistor, wherein said first resistor has a first resistance value, and wherein said first resistor has a first end and a second end, said second end of said first resistor being connected to ground, and said first end of said first resistor being connected with said first squib;

a first driver line, wherein said first driver line has a first end and a second end, said first end of said first driver line being connected with said first squib, and wherein the combination of said first driver line, said first resistor, and said first squib forms a first extended squib having a first resistance value;

a second squib;

a second resistor, wherein said second resistor has a second resistance value, and wherein said second resistor has a first end and a second end, said second end of said second resistor being connected to ground, and said first end of said second resistor being connected with said second squib;

a second driver line, wherein said second driver line being connected with said second squib, and wherein the combination of said second driver line, said second resistor, and said second squib forms a second extended squib having a second resistance value;

a driver unit having a first output and a second output, wherein said first output is connected with said second end of said first driver line, and wherein said second output is connected with said second end of said second driver line, and test circuitry built into said driver unit that enables verification of correct connection of said first squib with said first output of said driver unit and that enables verification of correct connection of said second squib with said second output of said driver unit.

* * * * *